US006332403B1

(12) United States Patent
Weise et al.

(10) Patent No.: US 6,332,403 B1
(45) **Date of Patent: *Dec. 25, 2001**

(54) AMMUNITION CARTRIDGE WITH ELECTRICALLY IGNITED PROPELLANT CHARGE

(75) Inventors: Thomas Weise; Hans Karl Haak, both of Unterlüss; Wolfgang Scherge, Hermannsburg, all of (DE)

(73) Assignee: TZN Forschungs- und Entwicklungszentrum Unterlüss GmbH, Unterlüss (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/568,509

(22) Filed: May 11, 2000

(30) Foreign Application Priority Data

May 11, 1999 (DE) ..... 199 21 530
Aug. 4, 1999 (DE) ..... 199 36 649

(51) Int. Cl.[7] ..... F42B 5/08

(52) U.S. Cl. ..... 102/472; 102/499; 102/202.5; 102/202.9

(58) Field of Search ..... 102/472, 499, 102/202.5, 202.9, 202.18; 89/28.05

(56) References Cited

U.S. PATENT DOCUMENTS 2,926,566 * 3/1960 Atkins et al. ..... 89/28
3,726,222 * 4/1973 White et al. ..... 102/46
5,044,278 * 9/1991 Campbell ..... 102/202.8
5,072,647 12/1991 Goldstein et al. .
5,231,242 * 7/1993 Chryssomallis et al. ..... 89/8
5,235,129 * 8/1993 Corney ..... 102/472
5,353,710 * 10/1994 Eches et al. ..... 102/443
5,503,081 * 4/1996 Lindblom et al. ..... 102/472
5,549,046 * 8/1996 Widner et al. ..... 102/202.7
6,247,411 * 6/2001 Vornfett ..... 102/472
6,247,412 * 6/2001 Vornfett ..... 102/472

FOREIGN PATENT DOCUMENTS 0 645 599 3/1995 (EP) .
2 343 500 5/2000 (GB) .

* cited by examiner

*Primary Examiner*—Charles T. Jordan
*Assistant Examiner*—Kimberly S Smith
(74) *Attorney, Agent, or Firm*—Venable; Gabor J. Kelemen

(57) ABSTRACT

An ammunition cartridge with electric propellant ignition includes a combustible case having a length dimension, a rearward end closed by a metal case bottom and a front end; a combustible propellant powder contained in the case; and an electrically insulated high-voltage electrode passing through the case bottom into the case. The electrode has an outer end situated externally of the case and is connectable to a current source and an inner end situated within the case. A current distributor is situated within the case and is electrically connected to the inner end of the electrode. At least three conductor wires are electrically connected to the current distributor and extend at least partially parallel to the length dimension within the case through the propellant powder. An electric contact arrangement is situated within the case in the front end thereof and is secured to the case. The electric contact arrangement is electrically connected to the conductor wires and has externally exposed contact locations which are connectable to an electrically conducting component externally of the case.

7 Claims, 1 Drawing Sheet

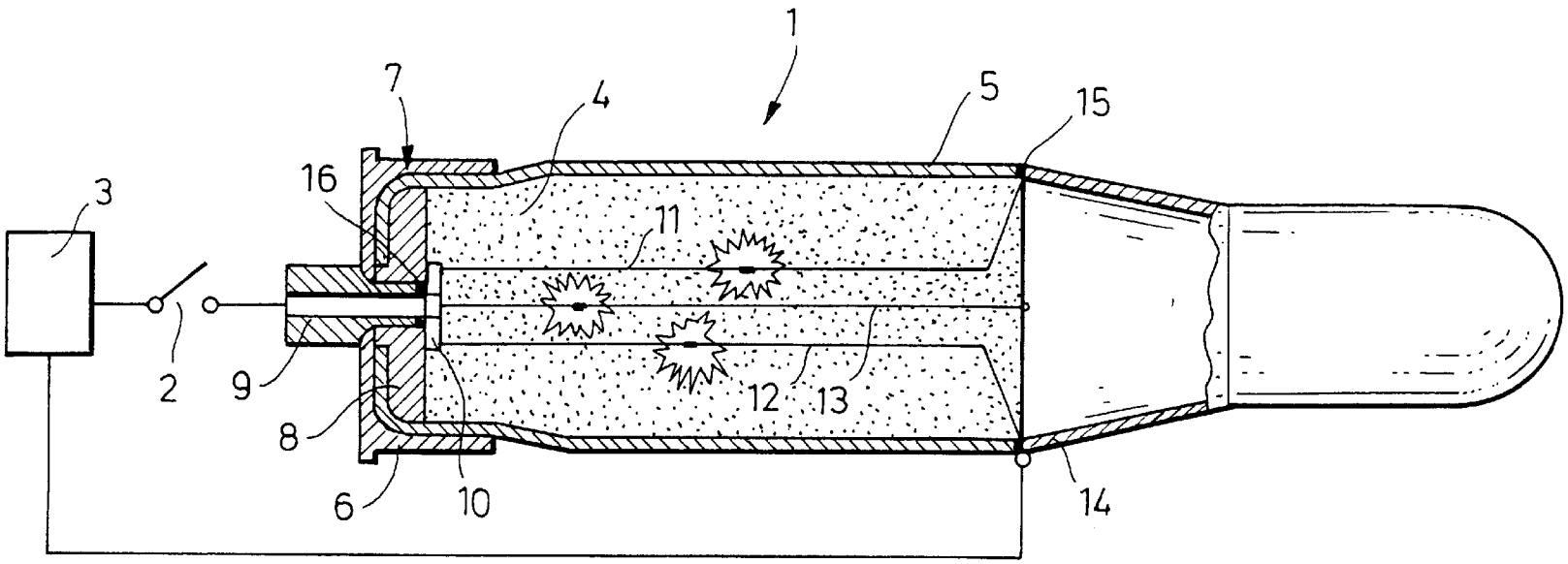
1
2
3
4
5
6
7
8
9
10
11
12
13
14
15
16

AMMUNITION CARTRIDGE WITH ELECTRICALLY IGNITED PROPELLANT CHARGE

CROSS REFERENCE TO RELATED APPLICATION

This application claims the priority of German Application Nos. 199 21 530.8 filed May 11, 1999 and 199 36 649.7 filed Aug. 4, 1999, which are incorporated herein by reference.

BACKGROUND OF THE INVENTION

This invention relates to an ammunition cartridge having an electrothermal ignition device for its propellant.

In ammunition cartridges of the above type the ignition of the propellant is effected by arc discharges inside the propellant powder. For this purpose, at least one wire conductor is provided within the propellant powder. For igniting the propellant powder, an electric current of such a high intensity is passed through the wire that the latter explosively vaporizes, and the electric arc thus produced ignites the surrounding propellant powder. The propellant powder is conventionally accommodated in an inert, electrically insulating plastic case.

It is a disadvantage of the above-outlined ammunition cartridges that in addition to the case bottom, the propellant case itself has to be completely removed every time a shot is fired. Further, the manufacture of such ammunition cartridges is relatively complex and expensive. Further, because of the relatively large proportion of the inert material, a substantial combustion volume is lost in the weapon chamber.

SUMMARY OF THE INVENTION

It is an object of the invention to provide an ammunition cartridge of the above-outlined type in which, after the cartridge is fired, the proportion of the uncombusted parts and thus the parts to be removed from the weapon is small without adversely affecting thereby the performance and/or the high-voltage resistance of the cartridge.

This object and others to become apparent as the specification progresses, are accomplished by the invention, according to which, briefly stated, the ammunition cartridge with electric propellant ignition includes a combustible case having a length dimension, a rearward end closed by a metal case bottom and a front end; a combustible propellant powder contained in the case; and an electrically insulated high-voltage electrode passing through the case bottom into the case. The electrode has an outer end situated externally of the case and is connectable to a current source and an inner end situated within the case. A current distributor is situated within the case and is electrically connected to the inner end of the electrode. At least three conductor wires are electrically connected to the current distributor and extend at least partially parallel to the length dimension within the case through the propellant powder. An electric contact arrangement is situated within the case in the front end thereof and is secured to the case. The electric contact arrangement is electrically connected to the conductor wires and has externally exposed contact locations which are connectable to an electrically conducting component externally of the case.

Thus, the invention is essentially based on the principle to provide a combustible propellant case having a metal case bottom through which an electrically well insulated high-voltage electrode is passed to which at least three electrically conducting wires are connected by a current divider. The wires extend at least partially parallel to the length dimension of the case through the propellant powder and are, in the frontal region of the case, connected with a contact part.

According to a preferred embodiment of the invention, the combustible case is, in the region of its rearward end, clamped with a form fit between the outer surface of a shaped insulating body and the inner surface of the case bottom. During the supply of electric energy the clamped case portion also serves as a high-voltage insulation between the electrode and the case bottom.

BRIEF DESCRIPTION OF THE DRAWING

The sole FIGURE is an axial sectional view of a preferred embodiment of the invention.

DESCRIPTION OF THE PREFERRED EMBODIMENT

The FIGURE illustrates a large-caliber ammunition cartridge (for example, tank gun ammunition) which, for igniting the propellant, is connected via a switch 2 with an energy source 3. The weapon and its barrel which holds the cartridge are not shown for the sake of clarity.

The cartridge 1 includes a case 5 made of a combustible material and filled with propellant powder 4 and a metal case bottom 6 closing the rearward end 7 of the case 5. The case 5 is immobilized in the region of its rearward end 7 in a form-fitting manner by being clamped between a shaped insulating body 8 and the case bottom 6.

An electrically insulated high-voltage electrode 9 passes centrally through the case bottom 6 and the insulating body 8 and is connected with a metal disk 10 which serves as a current distributor and which is disposed at the case bottom 6. Three electric conductor wires 11, 12 and 13 electrically connected and affixed to the current distributor 10 pass parallel to the length dimension of the case 5 through the propellant powder 4 and are connected in the region of the case lid 14 of the case 5 at the front end thereof with a contact part 15.

The contact part 15 may be an annular member or may be composed of individual contacts associated with the respective wires 11, 12, 13. The contact part 15 further has externally exposed portions so that upon loading the cartridge into the weapon barrel the contact part arrives in an electric contact with the inner wall of the grounded weapon chamber. In this manner an electric circuit may be closed through the grounded current source 3 by closing the switch 2.

The current distributor 10 threadedly engages the high-voltage electrode 9, whereby the case bottom 6, the case 5 and the insulating part 8 are clamped and firmly immobilized between the components 9 and 10. A silicone ring 16 is positioned and clamped between the high-voltage electrode 9 and the current distributor 10 and thus electrically seals the system.

For firing the cartridge 1 the switch 2 is closed and the energy source delivering a voltage of up to 40 kV and containing a series of charged condensers is abruptly discharged. The current generated as a result of the discharge causes an electric explosion of the wires 11, 12 and 13 and thus arc discharges are produced. The arcs ignite the propellant powder 4 which is thus combusted together with the combustible case 5. During the supply of the electric energy the combustible case, the propellant portions and the generated propellant gases act as an electric insulation so that the arc is guided to and maintained on the contact part 15 in the case lid 14. After firing the cartridge, the case bottom 6, the high-voltage electrode 9, the insulating part 8 and the current distributor 10 have to be removed before a new ammunition cartridge 1 can be introduced into the chamber of the weapon barrel.

It is to be understood that the invention is not limited to the described embodiment. Thus, for example, conductor rods may be used instead of wires.

Further, the current distributor 10 may be star shaped, in which case the respective wires 11, 12, 13 are affixed to the points of the star.

Also, the contact ring 15 does not have to be externally exposed necessarily in the zone of the case lid 14; instead, this may be effected in the frontal, cylindrical region of the propellant case.

It will be understood that the above description of the present invention is susceptible to various modifications, changes and adaptations, and the same are intended to be comprehended within the meaning and range of equivalents of the appended claims.

What is claimed is:

1. An ammunition cartridge with electric propellant ignition comprising (a) a combustible case having a length dimension, a rearward end closed by a metal case bottom and a front end;

(b) a propellant powder contained in said case;

(c) an electrically insulated high-voltage electrode passing through said case bottom into said case; the electrode having an outer end situated externally of said case and being connectable to a current source and an inner end situated within said case;

(d) a current distributor situated within said case and being electrically connected to said inner end of said electrode;

(e) at least three conductor wires electrically connected to said current distributor and extending at least partially parallel to said length dimension within said case through said propellant powder; and (f) an electric contact arrangement situated within said case in said front end thereof and being secured to said case; said electric contact arrangement being electrically connected to said conductor wires and having externally exposed contact locations being connectable to an electrically conducting component externally of said case.

2. The ammunition cartridge as defined in claim 1, further comprising an electrically insulating ring positioned between said electrode and said current distributor.

3. The ammunition cartridge as defined in claim 1, wherein said electric contact arrangement comprises a plurality of dot-shaped contacts connected to respective said conductor wires; said dot-shaped contacts being secured to said case and having externally exposed contact locations being connectable to an electrically conducting component externally of said case.

4. The ammunition cartridge as defined in claim 1, further comprising a shaped insulating body situated within said case at the rearward end thereof; said case having an end portion clamped between said case bottom and said shaped insulating body.

5. The ammunition cartridge as defined in claim 1, wherein said current distributor comprises a metal disk.

6. The ammunition cartridge as defined in claim 1, wherein said electric contact arrangement comprises a contact ring.

7. The ammunition cartridge as defined in claim 6, wherein said case has a case lid at said front end and further wherein said contact ring is situated in a region of said case lid.

* * * * *